United States Patent [19]

Cathiard

[11] 3,931,766

[45] Jan. 13, 1976

[54] CHAIRLIFT TERMINAL

[75] Inventor: Gaston Cathiard, Uriage, France

[73] Assignee: Pomagalski S.A., Fontaine, France

[22] Filed: Dec. 19, 1974

[21] Appl. No.: 534,470

[30] Foreign Application Priority Data

Dec. 20, 1973 France ..... 73.46437

[52] U.S. Cl. ..... 104/117; 104/125; 104/173

[51] Int. Cl.[2] ..... B61B 11/00

[58] Field of Search.....104/27, 89, 112, 117, 123–125, 104/172 R, 172 C, 172 S, 173 R, 173 ST, 178, 196

[56] References Cited

UNITED STATES PATENTS 3,326,140 6/1967 Wills ..... 104/173

3,728,969 4/1973 Goforth et al. ..... 104/173

*Primary Examiner*—John J. Love

*Assistant Examiner*—Andres Kashnikow

*Attorney, Agent, or Firm*—Stevens, Davis, Miller & Mosher

[57] ABSTRACT

The invention relates to the terminal of an overhead cable transporter in which the cable return sheave is suspended from a tensioning carriage moving on runways formed by two bracing girders fixed to two piers forming an inverted V.

7 Claims, 4 Drawing Figures

CHAIRLIFT TERMINAL

The invention relates to a terminal of an overhead transporter with a continuously moving cable, in particular a chairlift, comprising a cable return sheave with vertical axle carried by a steel framework.

A known terminal of the type mentioned includes a column installed in the centerline of the chairlift which hinders the access of the skiers to the departure point, under the return sheave.

The object of the present invention is to remedy this disadvantage and permit the realization of a particularly simple terminal, freeing a large area on the ground underneath the return sheave carried by a mobile carriage.

The steel framework of the terminal according to the invention has two piers in the form of an inverted V which permits a wide spacing of the footings whilst conserving a relatively small span of the parts from which is suspended the return sheave. This feature is appreciable in the case of a return sheave fixed to a carriage which moves in the axis of the line and which is subjected to the action of a device tensioning the cable of the installation. Bracing and support girders are then arranged as runways for the rollers of the carriage, which moves under the action of jacks or a counterweight in a manner well-known in itself. The carriage may also carry the driving device when the terminal is the drive terminal.

It is a further object of the invention to provide a terminal comprising extensions of the girders or runways in the form of projections to permit on the one hand the fixing of the portal at the exit from the terminal and on the other hand to provide an extension of the carriage runway.

Other advantages and features of the invention will become evident more clearly from the following description of a mode of application of the invention, given as a non-restrictive example and represented in the attached drawings, in which.

Figure 1:
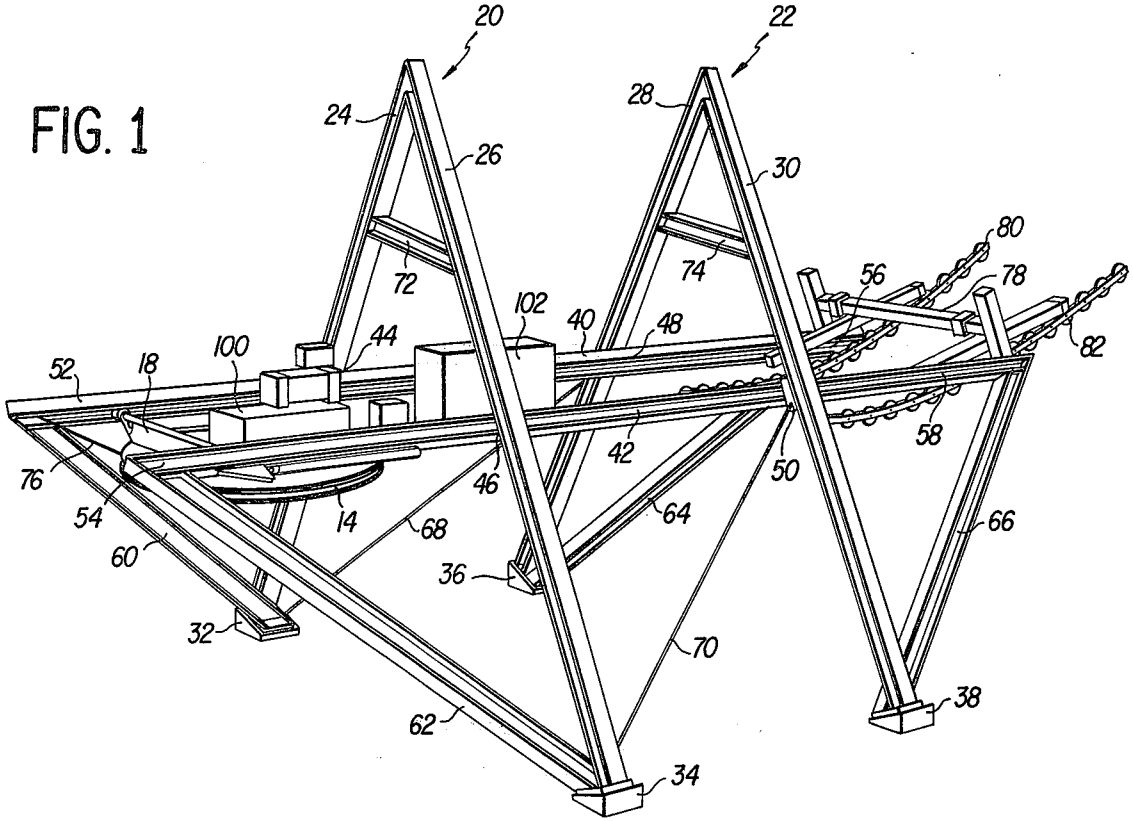
FIG. 1 is a schematic view in perspective of a chairlift terminal, the cable and protective hood not being shown.

In these Figures, a cable 10 of a monocable aerial transporter, in particular a chairlift, passes through a terminal, in particular a departure terminal with the general reference 12 over a terminal return sheave 14 of the cable 10. The return sheave 14 has an axle 16 which is appreciably vertical, and is fixed under a carriage 18.

Terminal 12 has a steel framework comprising two piers 20, 22 spaced in the line of the chairlift. The two piers are identical and each has two legs respectively, 24, 26, 28, 30 assembled in the form of an inverted V. The bases of legs 24 to 30 are fixed to footings 32, 34, 36, 38 consisting of concrete blocks. Piers 20, 22 are braced by means of two girders 40, 42 stretching parallel with the line of the chairlift and fixed to legs 24, 28 and 26, 30 by assembly joints 44, 46, 48, 50.

Bracing girders 40, 42 extend beyond the piers 20, 22 with projections 52, 54 pointing away from the direction of the line and 56, 58 pointing in the direction of the line. Struts 60, 62; 64, 66 connect respectively ends 52, 54, 56, 58 to footings 32, 34; 36, 38. Ties 68, 70 are stretched between joints 48, 50 and footings 32, 34 to reinforce the steel framework formed by piers 20, 22, bracing girders 40, 42 and struts 60 to 66. The framework may include other reinforcing components, in particular braces 72, 74 decreasing the buckling stresses exerted on legs 24 to 30. The projections 52, 54 are connected at their ends by a bar 76 and projections 56, 58 have fixed to their ends a beam 78 on which are fixed sheave-trains 80, 82 supporting cable 10. The assembly of beam 78 — sheave-trains 80, 82 forms the portal of terminal 12.

Before describing in more details the terminal 12, it is advisable to specify the mode of assembling the sections. The legs 24 to 30 are H sections, the webs of which are in the plane of the piers 20, 22 respectively. The main bracing and support-girders 40, 42 are also H sections, the treads of which are fixed at joints 44 to 50 flat against the treads of the leg sections 24 to 30. The webs of sections 40, 42 are thus inclined parallel with the associated legs.

The webs of the H sections forming struts 60 to 66 are in the plane of the web of the associated girder 40, 42. It is easily seen that the assemblies are simplified and may be realized by means of simple plates or angle-irons, bolted or welded to the parts to be assembled. The arrangement in the same plane of the bracing girder 40, 42 and the associated struts 60, 64, 62, 66 respectively permits the use of the same footings for the legs and the struts and the realization of simplified joints 44 to 50.

Figure 3:
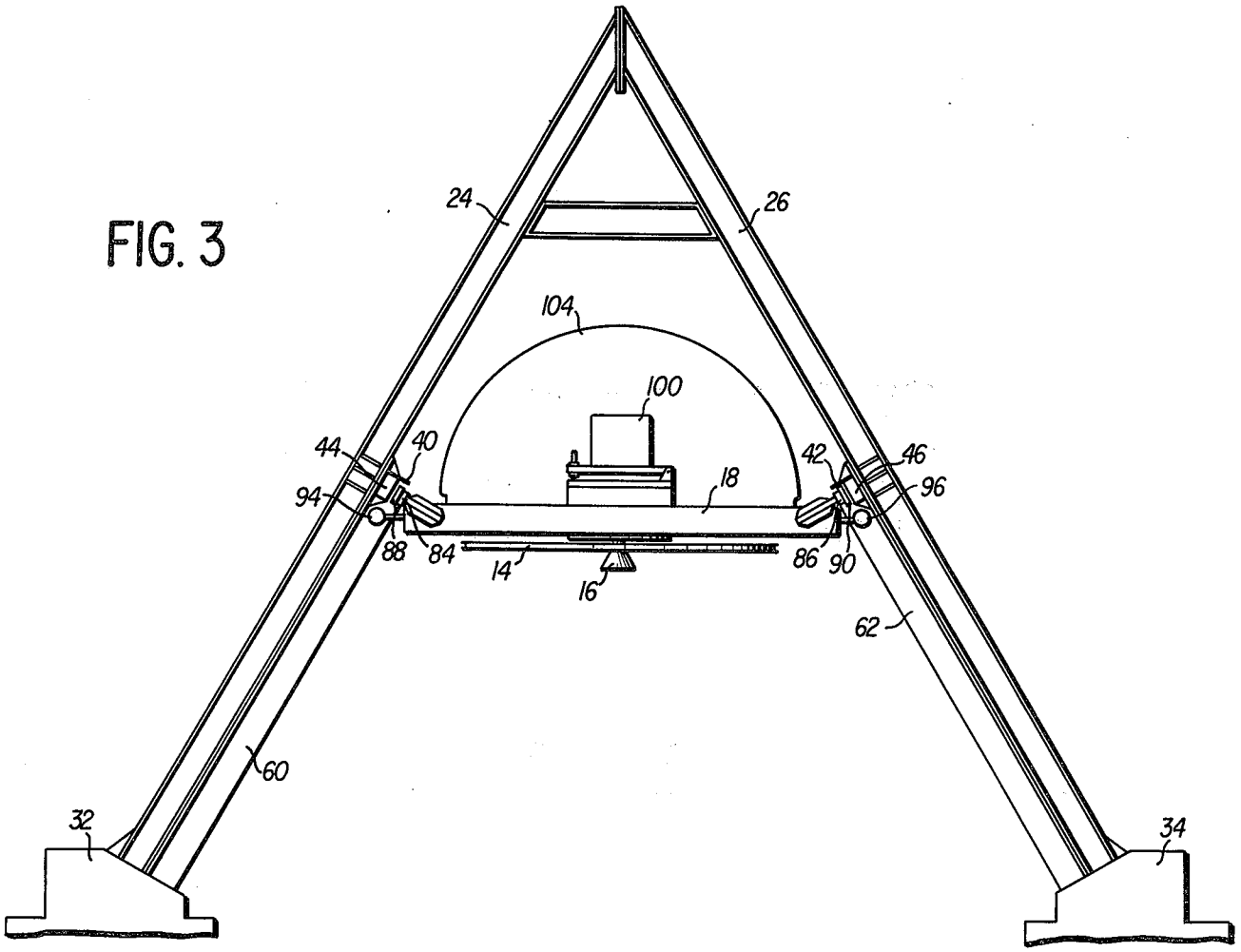
FIG. 3 is a view from the left of FIG. 2.

The bracing girders 40, 42 carrying portal 78 form runways for carriage 18 from which is suspended return sheave 14. For this purpose, the carriage 18 is equipped with two pairs of rollers 84, 86, the treads of which act in conjunction with the lower flanges 88, 90 respectively, of girders 40, 42, which form runways (see FIG. 3). The spindles of the rollers 84, 86 are inclined and parallel with the runway 88, 90, in order to obtain a self-centring of the carriage.

Figure 2:
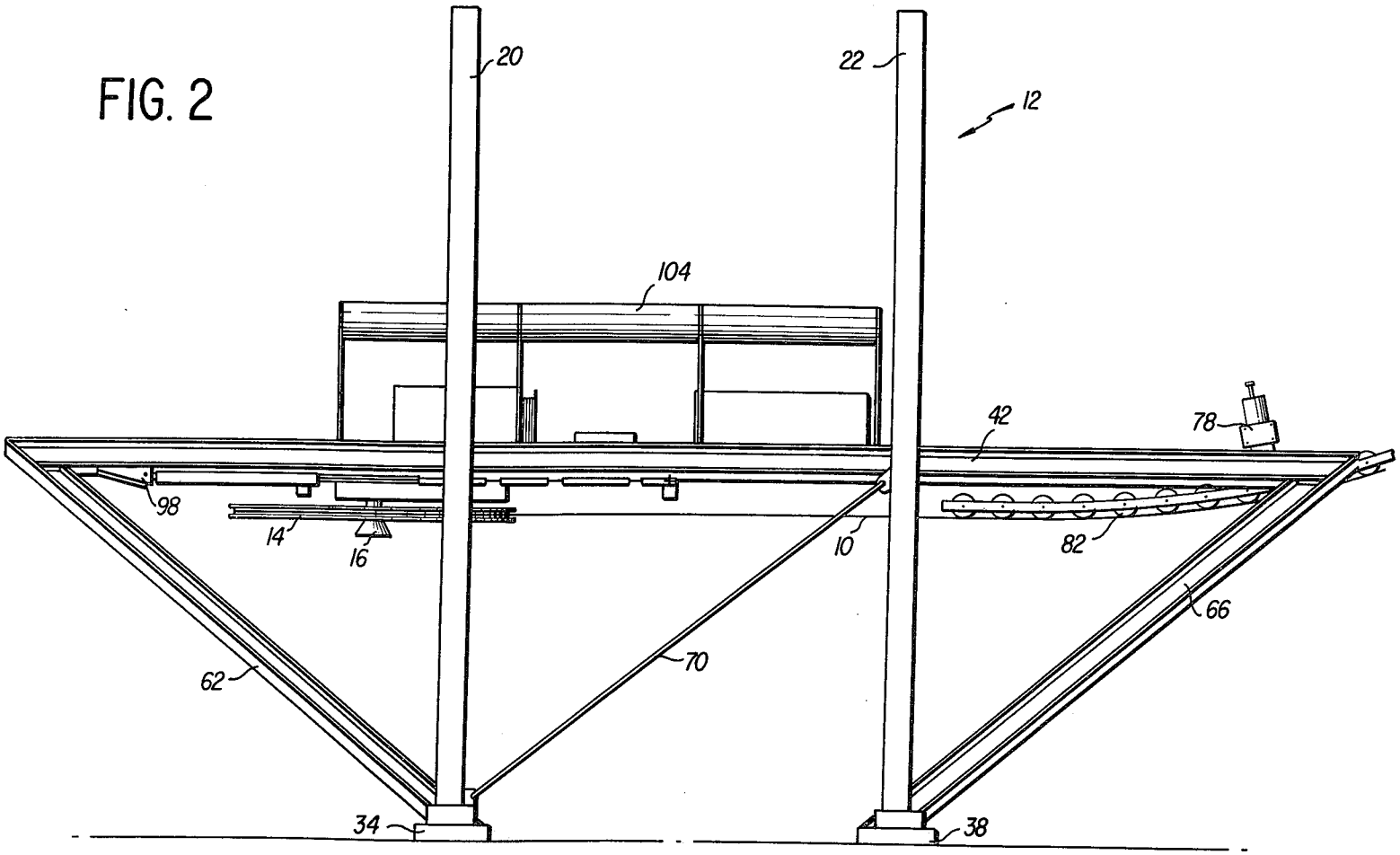
FIG. 2 is a view in elevation of the terminal shown in FIG. 1.
Figure 4:
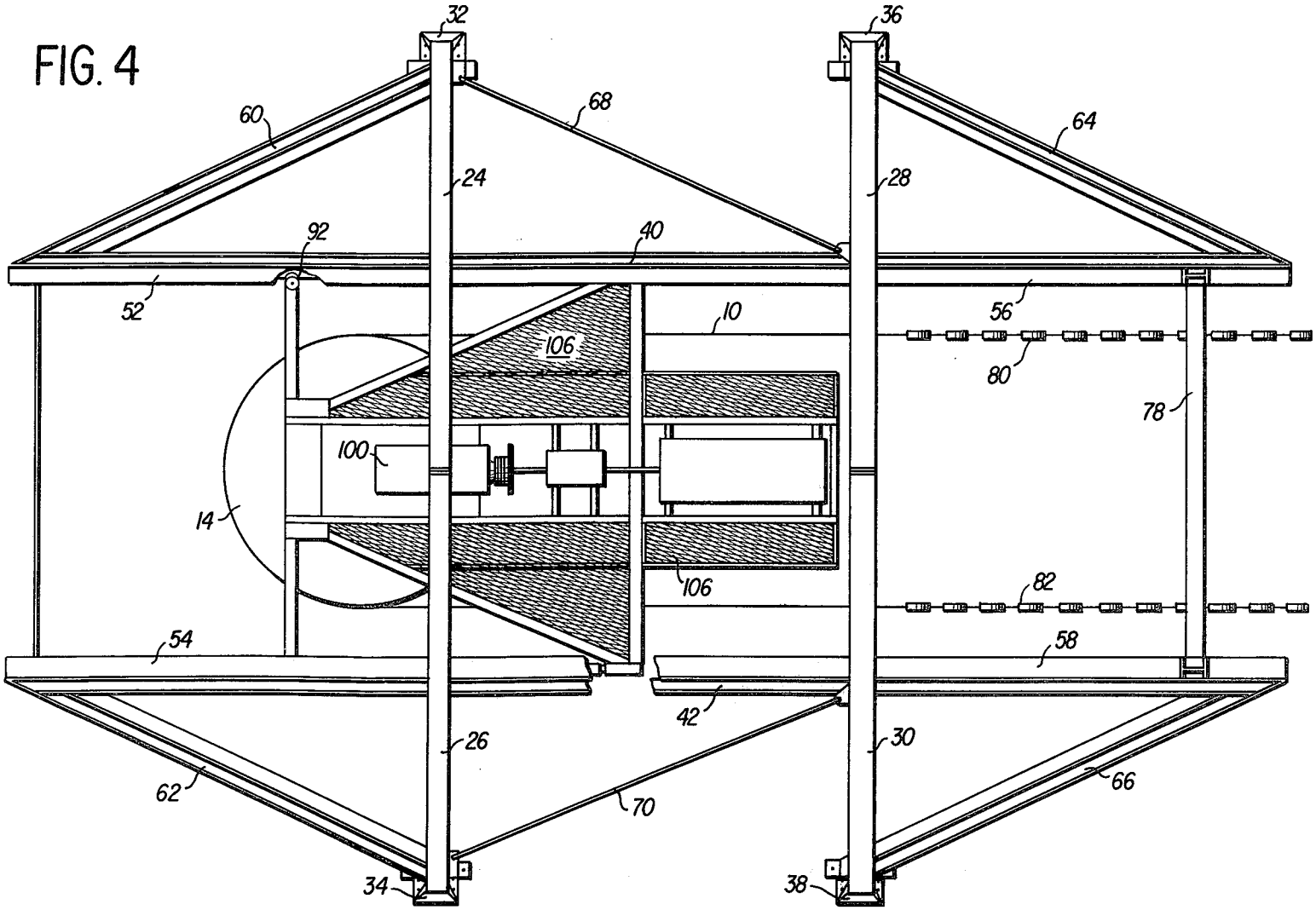
FIG. 4 is a view in plan, partly cut away and showing the access gangways.

Carriage 18 is equipped with guide rollers, of which one only 92 is shown in FIG. 4, opposing a pivoting of the carriage under the effect of drive torque. Carriage 18 is subjected to the action of two take-up jacks 94, 96 extending parallel with girders 40, 42, and bearing upon fixed points 98 on projections 52, 54 of girders 40, 42 (see FIG. 2). The take-up jacks 94, 96 exert pressure on the carriage 18 in the direction opposite to that of the chairlift-line, in such manner as to strain cable 10. Jacks 94, 96 may obviously be replaced by a usual counterweight system. In the case of a drive terminal, a main drive motor 100 and possibly a stand-by engine 102 are installed on the carriage 18 and are arranged to rotate the return sheave 14. Auxiliary components for control or protection, such as a hood 104, or for access, such as gangways 106, can also be provided on the carriage or on the frame.

It is unnecessary to describe the functioning of the terminal which is evident from the above account and it suffices to recall that this terminal may be, without importance, either a downhill terminal or an uphill terminal. In the example illustrated by the figures, the terminal is a drive terminal which at the same time provides the cable tension. It is clear that the steel structure may be used to the same advantage while carrying out only one of the functions mentioned above, that is the tensioning of the cable or the driving of the cable. The inverted V structure of piers 20, 22 provides a small spacing of runways 88, 90, restricting the span of carriage 18, in spite of the wide spacing of footings 32 to 38.

I claim:

1. Terminal of an aerial cable transporter with a continuously moving cable, comprising:

a cable return sheave with vertical axle, two triangular piers, each with legs in steel sections assembled in the form of an inverted V, with fixed bases, the piers standing in two spaced transversal planes perpendicular to the cable, two bracing and supporting girders symmetrically arranged on each side of the said cable and which rigidly interconnect the legs of the said piers and extend beyond at least one of the said piers to form a pair of projections, one train of compression sheaves carried by each of the said projections, and a means of suspension of the said return sheave from the said girders.

2. A terminal according to claim 1, comprising a carriage from which is suspended the return sheave and able to run on the said girders.

3. A terminal according to claim 2, in which the said legs are formed of H sections with the webs in the said transversal planes, and in which the said girders are in H sections fixed to the said legs, the said carriage running on the said girder sections.

4. A terminal according to claim 1, with, associated with each girder, a strut connecting the said projection with the base of the associated leg.

5. A terminal according to claim 1, comprising a second pair of projections.

6. A terminal according to claim 2, comprising two take-up jacks each associated with one of the said girders and acting on the said carriage.

7. A terminal according to claim 2, with components carried by the said carriage for driving the said sheave.

* * * * *